United States Patent [19]

Hare et al.

[11] Patent Number: 4,490,329

[45] Date of Patent: Dec. 25, 1984

[54] IMPLOSIVE CONSOLIDATION OF A PARTICLE MASS INCLUDING AMORPHOUS MATERIAL

[75] Inventors: Alan W. Hare, Port Angeles, Wash.; Lawrence E. Murr, Tigard; F. Paul Carlson, Portland, both of Oreg.

[73] Assignee: Oregon Graduate Center for Study and Research, Beaverton, Oreg.

[21] Appl. No.: 530,268

[22] Filed: Sep. 8, 1983

[51] Int. Cl.[3] ..... B22F 1/00; B22F 1/02

[52] U.S. Cl. ..... 419/51; 29/608; 148/31.55; 148/403; 428/940

[58] Field of Search ..... 75/230, 236, 240, 244, 75/246, 248; 419/36, 42, 48, 49, 51, 68; 72/56; 29/608; 148/31.55, 403; 428/611, 900, 928, 940

[56] References Cited

U.S. PATENT DOCUMENTS 3,081,498 2/1963 Davis et al. ..... 419/51 X

FOREIGN PATENT DOCUMENTS 784989 12/1980 U.S.S.R. ..... 419/38

*Primary Examiner*—Leland A. Sebastian

*Attorney, Agent, or Firm*—Kolisch, Hartwell, Dickinson & Anderson

[57] ABSTRACT

A method for the implosive consolidation into a solid body of a mass of free particles, which mass consists, selectively, entirely of amorphous particles, or a mixture of amorphous and nonamorphous particles. During the consolidation act, pressure and temperature are controlled in a manner which assures that the consolidated amorphous particles in the solid body exhibit substantially the same amorphous characteristics as those displayed by the unconsolidated, free amorphous particles.

6 Claims, 7 Drawing Figures

IMPLOSIVE CONSOLIDATION OF A PARTICLE MASS INCLUDING AMORPHOUS MATERIAL

BACKGROUND AND SUMMARY OF THE INVENTION

This invention pertains to the implosive compacting and consolidating of powders (typically particles or flakes) made up, alternatively, either entirely of an amorphous material, or of a mixture of amorphous and nonamorphous materials. The invention is especially suited to practice with amorphous, magnetic, iron-based and related alloys, such as those sold under the name Metglas—a registered trademark of Allied Corporation. More particularly, the invention features a method for such compaction and consolidation performed under the influence of explosives.

For the purpose of explanation herein, a preferred method of practicing the invention is described in conjunction with the manufacture of electromagnetic device components, such as simple magnetic motor stator rings, respecting which the invention has been found to have particular utility.

Amorphous metals and alloys have been produced to date only as ribbons having a limited thickness and width, and as powders in the form of particles or flakes which have been generated from such ribbon. In electromagnetic applications, where such amorphous materials have high utility, uses of the ribbon form have been limited to laminations or configurations which can be constructed from laminate stacks. Uses of powder flakes, resulting from consolidation of powders by conventional powder metallurgy techniques, in the same sorts of settings, are unsatisfactory because temperatures in excess of the crystallization temperatures, and other inducements to crystallization, cause catastrophic loss of properties as a consequence of reversion to the crystalline state from the amorphous or glassy state.

In recent work by one of us, we discovered that the passage of shock waves from an explosive charge driving a metal plate against an assembly of laminated amorphous Metglas ribbon did not cause crystallization to occur, and did not result in loss of important amorphous properties, such as magnetic permeability and hardness. The pressure used in this work was as high as 350 kilobars. This discovery led to the realization, which lies at the focal point of the present invention, that it would be possible to use explosives to compact and consolidate amorphous powders if overheating and interparticle melting could be avoided.

At about the same time as the work just above related, another of us recognized that utilization of materials with very high permeabilities, such as might be attained by the consolidation of amorphous magnetic alloys, or mixtures of magnetic amorphous alloys and other constituents, could provide for significant advances and efficiencies in electromagnetic devices, such as transformers, magnetic amplifiers, sensors and a wide range of motors. Of particular interest in this recognition was the foreseeable concept of utilizing magnetic amorphous materials having broad-band (frequency response) characteristics, and nonsaturation linearity. In particular, through the selection of particular magnetic amorphous materials, and mixtures of these materials and other materials, magnetic properties of an implosively consolidated body could be tailored to suit particular different end circumstances.

Accordingly, an important general object of the present invention is to provide a method for the implosive compacting and consolidating of amorphous or glassy magnetic powders, as well as mixtures of such powders with other materials, into magnetic and/or electromagnetic products, with a precisely given shape, and with retention of the unique and extraordinary properties of such amorphous materials essentially completely preserved in the final products.

An object intimately related to the one just stated is to provide such a method which features special control of pressure and temperature during the act of consolidation, in a manner which assures that the finally consolidated amorphous particles reliably exhibit substantially the same amorphous characteristics as those displayed by the unconsolidated, free amorphous particles which existed in the preconsolidation mass.

Another object of the present invention is to provide a method of the type so far generally outlined which is simple and inexpensive to perform, and which is capable of yielding quite accurately-shaped final products in an infinite variety of preselected configurations.

According to a preferred method of practicing the invention, the same generally involves: assembling a mass of particles, which may include entirely amorphous particles, or alternatively, a mixture of amorphous and nonamorphous particles, to define, in the assembled but unconsolidated state, a chosen configuration for a finally desired solid body; imploding the assembled mass by an external, substantially surrounding explosive force in a manner which bonds the particles in the mass as a unit to form the desired solid body; and during this imploding step, controlling the pressure and temperature which occur in the consolidating mass to assure that recrystallization of the amorphous particles in the mass, and thereby loss of important amorphous characteristics, does not occur.

As was mentioned earlier, through selection of particular amorphous powders or powder mixtures, the finally desired amorphous qualities, such as hardness, wearability, and magnetic permeability, can be selected, with shape in a final product determined easily by the manner in which the particles are first assembled in an unconsolidated mass. By combining with amorphous particles selected nonamorphous particles, such as hard metallic particles, like tungsten or nickel-base super alloy particles, or hard compound particles, such as alumina (aluminum oxide), tungsten carbide, titanium carbide, boron nitride, or mixtures of some of these, other important characteristics, such as mechanical or structural characteristics, in the finally consolidated body can easily be controlled.

Still a further advantage of the method proposed by the invention is that it is possible, where desirable, to produce, during the act of particle consolidation, a bond between the finally consolidated body and another object. Thus, the method of the invention lends itself to a manufacturing process in which components, one of which it is desired to form with amorphous characteristics, can be assembled during a single implosive consolidation act.

Apparatus for practicing the method of the invention can take a variety of forms. Typically, it includes a container (mold or die or the like) for containing the unconsolidated powder, and for controlling the final shape of the consolidated product. In some instances, where the consolidated powder is to be assembled with another part, this other part may itself function as all or part of the mold for the powder.

Various conventional explosives may be used, as will be explained hereinbelow, with these taking the form typically of powders or slurries which surround the selected mold for the product, with such powder or slurry itself contained in an overall arrangement that allows the body of explosive material to be detonated in such a way that the powder, at the operator's selection, is uniformly, or differentially, consolidated during a consolidation act.

Various other objects and advantages which are attained by the invention will become more fully apparent as the description which now follows is read in conjunction with the accompanying drawings.

DETAILED DESCRIPTION OF THE INVENTION

Figure 1:
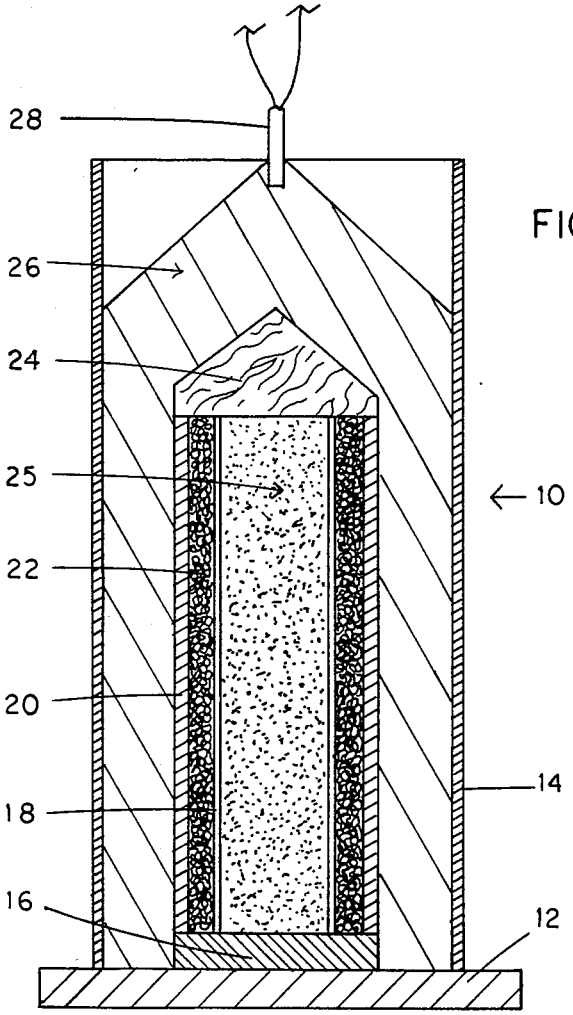
FIG. 1 is a simplified cross-sectional view illustrating one arrangement for practicing the method of the invention.
Figure 5:
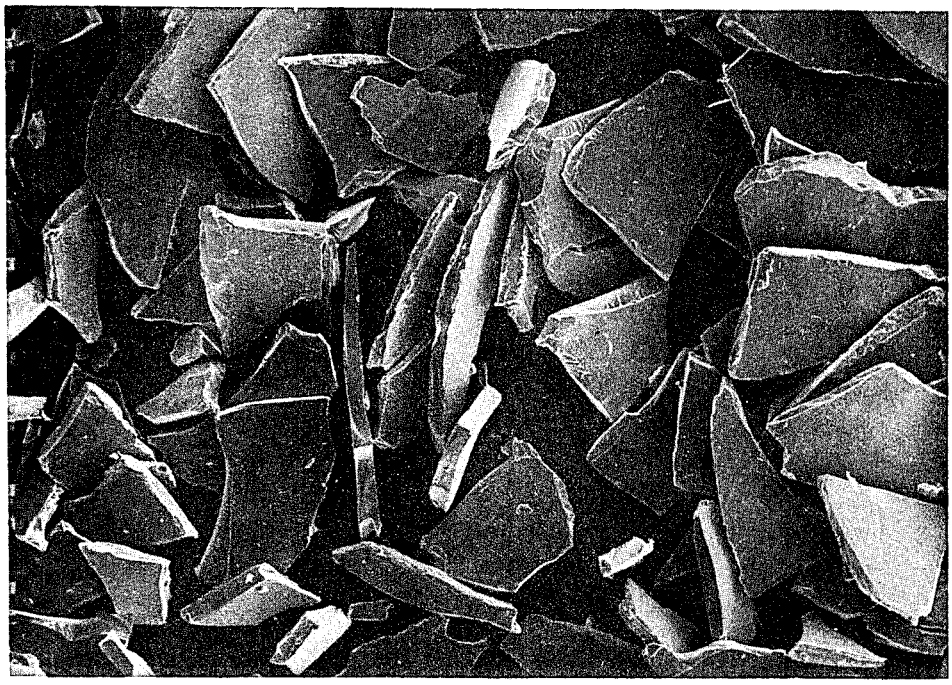
FIG. 5 is a photograph, produced at 250-times magnification from a scanning electron microscope, showing an unconsolidated collection of amorphous particles as they appear in a mass just prior to consolidation.

Turning now to the drawings, and referring first of all to FIG. 1, here there is indicated, in somewhat simplified form, an apparatus arrangement which is usable, simply and conveniently, to produce one form of a solid body according to the method of the present invention. In the procedure which is now to be described, the body to be formed has been selected with an elongated cylindrical tubular configuration, and is to be formed from an Allied Corporation Metglas powder which is designated by Allied as 26055-2, and which has the following composition: $Fe_{78}B_{13}Si_9$. This powder, in its unconsolidated form, is made up of free-flowing particles which, under high magnification as is shown in FIG. 5, comprise flakes of material. With respect to the particular powder which is now being described in conjunction with practicing the invention, the particles in the powder can be defined as falling within a range of mesh sizes between about mesh 60 and about mesh 100. Further, and while this is obviously a matter of user's choice, the tube which is to be formed is intended to have a length of about 10-cm, an outside diameter of about 2.5-cm, and a wall thickness of about 7-mm. This tube may later be machined, and cross-cut into rings for performance in electromagnetic motors.

The apparatus which is shown in FIG. 1 generally at 10 is designed for the production of such a tube, and to this end, includes a steel base plate 12 on the top which suitably rests a cylindrical steel jacket 14. Jacket 14 herein has an inside diameter of about 10-cm and an axial length of about 15-cm.

Resting axially centrally on top of plate 12, within jacket 14, is a circular wooden support plate 16 which has a diameter of about 3-cm. Suitably supported as shown on top of plate 16 are inner and outer sleeves, 18, 20, respectively, which are tubular and cylindrical in nature, and which are formed herein of cardboard. The outside diameter of inner sleeve 18 is about 1.2-cm, which is the intended inside diameter of the finally-to-be-formed amorphous product. The inside diameter of outer sleeve 20 is about 2.5-cm, which is the same as the intended outside diameter of the final product, and the outside diameter of this sleeve is substantially the same as that of plate 16. Sleeves 18 and 20 each has an axial length which is the same as that intended for the final product.

Distributed as shown in the tubular space which resides between the inner and outer sleeves is an unconsolidated mass of Metglas particles having the composition mentioned above. This mass is shown at 22 in FIG. 1.

Resting on top of sleeves 18, 20 is a wooden cap 24 having an conical upper surface shaped as shown in FIG. 1.

Filling the inside of sleeve 18, between plate 16 and cap 24, is a support column of sand 25.

In the procedure which is now to be described, a suitable composition explosive, such as amatol, a mixture of ammonium nitrate, fuel oil and perlite, has been selected for use, and this explosive is shown generally at 26 appropriately distributed for use with respect to apparatus 10. Nestled into the conical top of explosive 26 is a conventional detonator, such as blasting cap 28. When this type of "wet" explosive is used, the outer jacket tube extends up to the dotted line shown in FIG. 1.

The designated explosive has been selected particularly to provide the following detonation parameters which, as will be explained, result in the desired proper consolidation of mass 22 into the finally desired solid amorphous body: detonation velocity of about 2900-m/sec, producing a pressure of about 150 kilobars. Further explaining, the Metglas particles in mass 22 are characterized by what might be thought of as a co-consolidation pressure of about 150 kilobars, which is the pressure that must be reached and/or exceeded in order to assure solid-body consolidation of the particles in the mass, and an antiamorphic temperature limit of about 450° C., which must not be exceeded if recrystallization in the particles is to be avoided. The detonation characteristics just described for explosive 26, in the setting illustrated in FIG. 1, amply meet these criteria, and further, and because of the manner in which the explosive is distributed, as shown relative to apparatus 10, produce uniform consolidation in all parts of the particle mass. In particular, the detonation parameters specified, during an explosion, produce a pressure on the mass of particles of about 150 kilobars, with a temperature, throughout the entire explosion process, not exceeding about 400° C.

Figure 6:
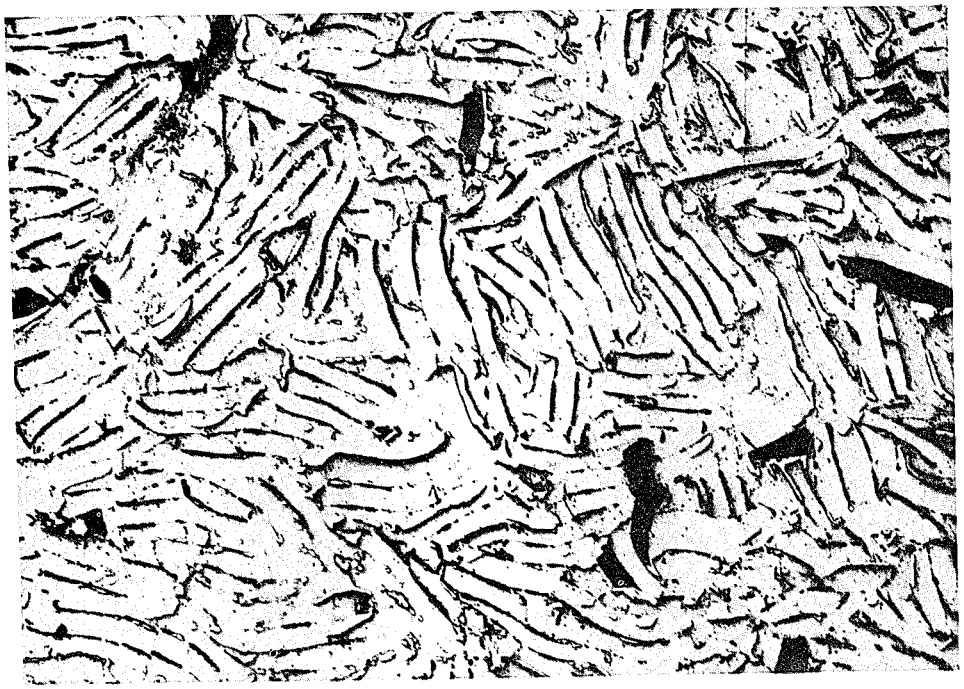
FIG. 6 is a similar photograph, produced at 150-times magnification, showing a post-procedure consolidation of particles like those shown in FIG. 5, viewed from a sample which has been polished and etched to show interparticle boundaries.
Figure 7:
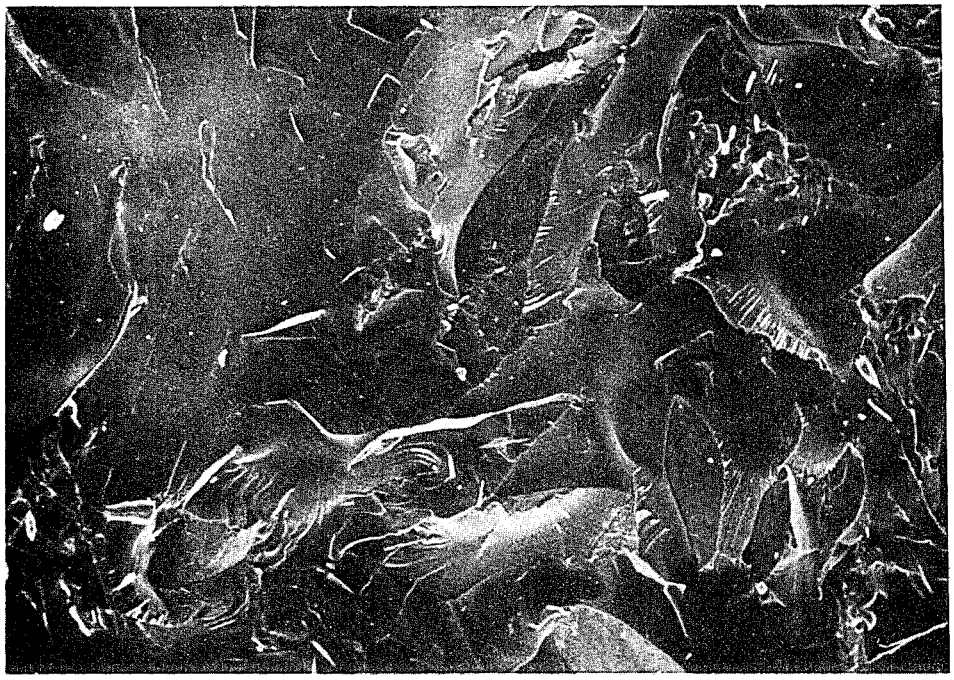
FIG. 7 is a photograph produced in the manners of FIGS. 5 and 6, at 400-times magnification, showing a fracture surface from an amorphous solid body produced in accordance with the invention.

Following such a consolidation process, all of which takes about 5-microseconds (herein put time), there results a solid tube wherein substantially complete consolidation of the originally free particles has taken place. FIG. 6 has been prepared to illustrate the extremely void-free post-consolidation condition of such particles, and FIG. 7, a fracture surface, clearly shows the amorphous glassy nature of the finally consolidated product.

With the particular Metglas particles which have been discussed so far, the material in the final product is ideal for many electromagnetic applications. For example, with a solid tube formed from the apparatus of FIG. 1, the same can then be cross-cut into plural annular rings which may form, for example, parts for electric motors.

As mentioned above, the particular explosive described in a slurry which is easily prepared and poured, and which can readily be altered in composition to change the detonation velocity over a range from about 1500- to about 3000-meters-per-second to suit different applications.

Figure 2:
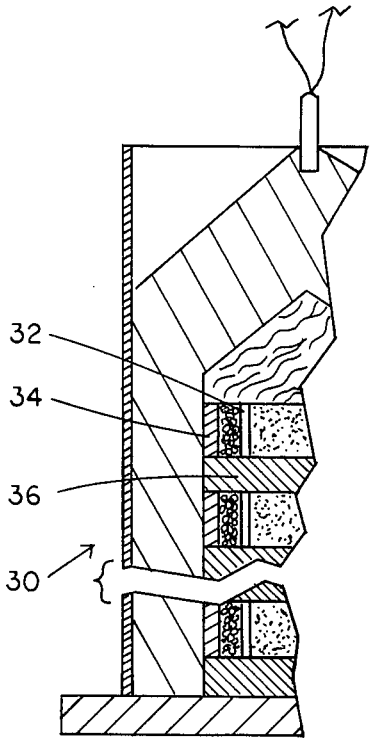
FIGS. 2, 3 and 4, each in fragmentary form, are similar to FIG. 1, with each of these three figures showing a modified arrangement for practicing the method of the invention.

The apparatus in FIG. 2 illustrates another apparatus arrangement for practicing the invention in which plural annular rings may be formed in a single consolidation action, without subsequent cross-cutting of a long cylinder. Here there is shown at 30 a modified form of apparatus 10 which differs principally in that previously-described inner and outer sleeves 18, 20 are replaced by sets of short-length inner and outer sleeves, like those shown at 32, 34, respectively. The respective pairs of these sleeves are stacked one upon another with circular spacers, such as spacer 36, provided between adjacent pairs.

Figure 3:
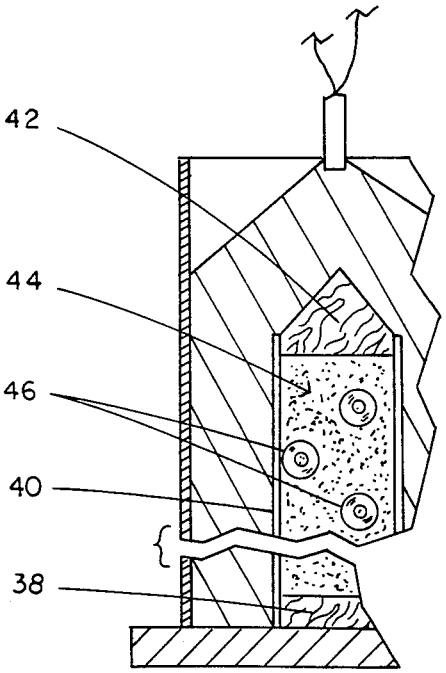

FIG. 3 in the drawings shows yet another approach to the explosive consolidation production simultaneously of plural articles. Here, in the center of the apparatus resting on the base plate, is a central circular support plate 38 which supports an upstanding sleeve 40. A conical cap 42 closes off the top of sleeve 40, and the inside of the sleeve, between plate 38 and cap 42 is largely filled with sand 44. Distributed within the sand are plural, closed annular molds formed of any suitable material, such as cardboard—two of these molds being shown at 46—with each of these molds being filled with the same Metglas powder described earlier.

In each of the three apparatus arrangements disclosed so far, because of the way in which the explosive material is distributed, uniform consolidation occurs for the entire mass of amorphous particles.

Figure 4:
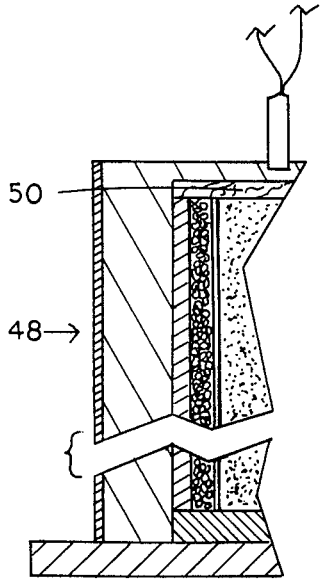

FIG. 4 shows a modified form of apparatus in which what might be thought of as differential consolidation takes place, largely because of the way in which the upper part of the explosive charge is formed. As can be seen in FIG. 4 for the apparatus 48 which is shown therein, two principal differences evidence themselves, vis-a-vis what is shown in FIG. 1. The first is that conical cap 24 in FIG. 1 is replaced in FIG. 4 with a flat circular cap 50. The second important difference is that the upper portion of the explosive material is flat-formed (without a conical top).

When detonation takes place in this form of apparatus, consolidation in the finally produced body is different at the top of the contained column of particles than it is at the bottom. With the dimensions of this column of particles being the same in FIG. 4 as described with respect to FIG. 1, the consolidation difference between particles at the top of the column and particles at the base of the column can be described as follows: since the pressure increases from about 100 kilobars at the top to as much as 1000 kilobars at the bottom, the powder will be subjected to these various consolidation pressures along the axial length. This can be used as a method to identify the optimum pressure by examining the degree of consolidation along the final consolidated sample, or of actually producing differential consolidation along a cylindrical specimen.

As was mentioned earlier, if it is desired that the implosive consolidation action result not only in a consolidated amorphous body, but also in a bonding of this body to other structure, such other structure may take the form of part of all of the mold or die provided for assembling the mass of unconsolidated particles. For example, if it were desired, and again speaking with reference to FIG. 1, to produce a final structure which were to take the form of a tube of amorphous material bonded to a surrounding jacket of aluminum, the cardboard outer sleeve 20 in FIG. 1 could readily be replaced with an aluminum sleeve. Under the detonation parameters described in conjunction with FIG. 1, bonding will occur to such a sleeve in the arrangement described.

Obviously, the final configuration of a desired product is a matter of designer's choice, and can take on an infinite variety. With extremely complex shapes, it may be desirable to practice the invention utilizing a wet slurry explosive as distinguished from a dry explosive, in order to assure that the explosive material properly surrounds the to-be-consolidated material.

Also, and while specific illustrations have been given with respect to the consolidation of a mass of particles consisting entirely of amorphous particles, there are many applications in which certain structural advantages that are offered by other materials can be produced in a final consolidated body, without destroying the characteristics of the amorphous particles therein, by beginning with a mixture of amorphous and nonamorphous particles. The relative percentages and natures of such particles, obviously, dictate the final structural characteristics. As a way of illustrating, amorphous particles may be mixed with particles such as tungsten carbide in a ratio of 2:1 or 3:1 to form a very hard tool material which, when consolidated, could be bonded to a common metal or alloy for easy fastening. The tungsten carbide hard particles would, in this arrangement, be consolidated into a continuous mass of almost equally hard amorphous binder. There are no currently known equivalent hard metal or alloy binder particles, that is crystalline metal or alloy hard particles. As a consequence, the metal binder in tool materials will wear away rapidly, exposing the hard particles such as tungsten carbide, which eventually falls out, and the wear process continues. The use of amorphous binders can greatly reduce this wear process if the tool's operating temperature is kept below the crystallization temperature of the amorphous binder.

There is thus proposed by the method of the present invention a unique way of producing a solid body structure, including amorphous structure, which retains the amorphous characteristics of free unconsolidated particles from which it is entirely or partially formed. Employing explosive force to implode a mass of such particles into a solid-body condition rests upon the critical factors of achieving the necessary co-consolidation pressure, while not exceeding what has been referred to above as the antiamorphic temperature limit. Repeated practice of this invention with different amorphous materials, and with mixtures of such materials with other materials like those identified above, have shown that the consolidated amorphous particles retain substantially identical amorphous characteristics as those displayed by the free unconsolidated particles.

Accordingly, while a preferred method, and certain modifications thereof, of practicing the present invention have been disclosed herein, it is appreciated that other variations and modifications are possible and may be made without departing from the spirit of the invention.

It is claimed and desired to secure by Letters Patent:

1. A method for the implosive consolidation, into a solid body, of a particulate mass comprising free amorphous particles, said method including the steps of assembling such a mass to define, in the assembled but unconsolidated state, a chosen configuration for such a body, imploding the assembled mass by an external, substantially surrounding explosive force in a manner bonding the particles in the mass as a unit to form a solid body having such chosen configuration, and controlling said imploding in such a fashion that the contribution made to such body by such amorphous particles retains substantially the same amorphous characteristics as those exhibited by the unconsolidated amorphous particles.

2. The method of claim 1 which is performed with a particulate mass including a mixture of amorphous and nonamorphous particles.

3. A method for the implosive consolidation, into a solid body, of a particulate mass comprising free amorphous particles, where such amorphous particles are characterized by a known co-consolidation interface pressure and a known antiamorphic temperature limit, said method including the steps of assembling such a mass to define, in the assembled but unconsolidated state, a chosen configuration for such a body, producing an explosion in a region at least partially surrounding the assembled mass to create an imploding force thereon which generates a pressure on the totality of the assembled mass that is at least equal to such co-consolidation interface pressure, and which creates, in the space occupied by the mass, a temperature throughout the duration of the explosion which is less than such antiamorphic temperature limit, and by said producing, imploding the assembled mass to form such a body having such a chosen configuration.

4. The method of claim 3 which is performed with a particulate mass including a mixture of amorphous and nonamorphous particles.

5. A method for the implosive consolidation of free amorphous particles into a solid amorphous body comprising assembling such particles to define, in the assembled but unconsolidated state, a chosen configuration for such a body, and imploding the assembled particles by an external, substantially surrounding explosive force in a manner bonding the particles as a unit to form such a solid body having such a chosen configuration, with the body of bonded particles exhibiting substantially the same amorphic characteristics as did the prebonded particles.

6. A method for the implosive consolidation of free amorphous particles into a solid amorphous body, where such particles are characterized by a known co-consolidation interface pressure and a known antiamorphic temperature limit, said method comprising assembling such particles to define, in the assembled but unconsolidated state, a chosen configuration for such a body, producing an explosion in a region at least partially surrounding the assembled particles to create an imploding force thereon which generates a pressure on the totality of the assembled particles that is at least equal to such co-consolidation interface pressure, and which creates, in the space occupied by the particles, a temperature throughout the duration of the explosion which is less than such antiamorphic temperature limit, and by said producing, imploding the particles to form such a consolidated body having such a chosen configuration.

* * * * *